US005768919A

United States Patent [19]

Kurschatke

[11] Patent Number: 5,768,919

[45] Date of Patent: Jun. 23, 1998

[54] TREATMENT DEVICE FOR TEXTILE WEBS

[75] Inventor: Wolfgang Kurschatke, Krefeld, Germany

[73] Assignee: Eduard Küsters Maschinenfabrik GmbH & Co. KG, Krefeld, Germany

[21] Appl. No.: 732,484

[22] PCT Filed: Mar. 21, 1995

[86] PCT No.: PCT/DE95/00380

§ 371 Date: Dec. 31, 1996

§ 102(e) Date: Dec. 31, 1996

[87] PCT Pub. No.: WO95/29280

PCT Pub. Date: Nov. 2, 1995

[30] Foreign Application Priority Data

Apr. 21, 1994 [DE] Germany ..... 44 13 871.7

[51] Int. Cl.[6] ..... D06B 3/20

[52] U.S. Cl. ..... 68/170; 68/158; 68/175

[58] Field of Search ..... 68/148, 152, 153, 68/154, 155, 156, 158, 170, 175

[56] References Cited

U.S. PATENT DOCUMENTS 2,963,893 12/1960 Kusters ..... 68/158 X
4,047,404 9/1977 Hayashi .

FOREIGN PATENT DOCUMENTS 2313490 12/1976 France .
690530 4/1940 Germany .
21 39 651 2/1973 Germany .

*Primary Examiner*—Philip R. Coe
*Attorney, Agent, or Firm*—Kenyon & Kenyon

[57] ABSTRACT

A treatment device (100) for a textile web (1) comprises a drum (20), rotatable in a container (2) with a treatment liquid (4), around which the web (1) is wrapped. The ends of the drum (20) are supported on bearing plates (10) arranged near the fronts of the container (2). The bearing plates (10) are supported at the upper end on an eccentric (6), opposite the lower end of which there is a torque support (9). As the eccentric rotates, the bearing plates (10) with the drum (20) and the web (1) wrapped around it are caused to oscillate in the treatment liquid (4).

19 Claims, 8 Drawing Sheets

FIG. 4
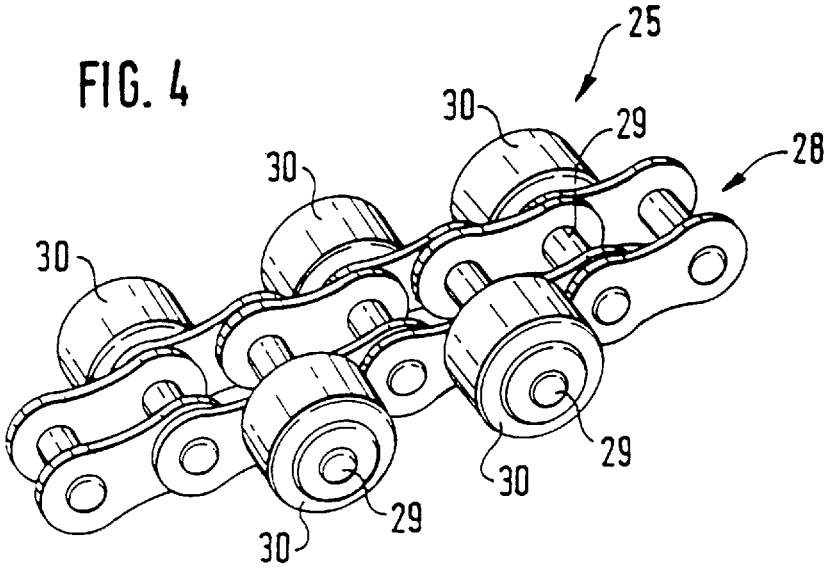
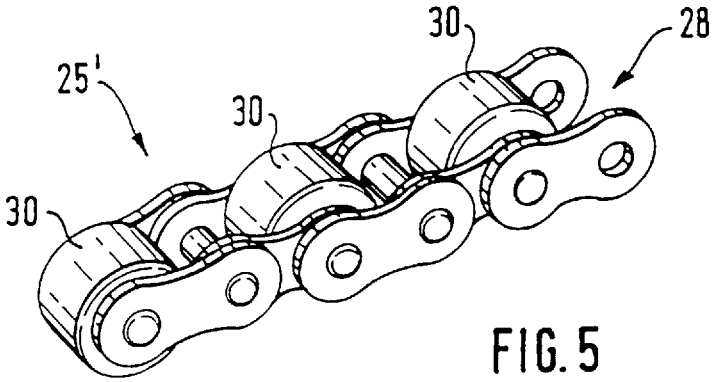
FIG. 5

43
52
55
56
53
54
33
63
6
A
E
B
65
64
60
67
66
13
17
10
59
57
58
69
61
2'
36
51
62
20
21
22
50
49
15
48
2

TREATMENT DEVICE FOR TEXTILE WEBS

FIELD OF THE INVENTION

The present invention relates to a treatment device for a continuously passing textile web.

BACKGROUND OF THE INVENTION

A treatment device of this kind is known from DE Patent 690 530. In the known embodiment, there is arranged resiliently above the level of the treatment liquid a plate on which an oscillator with a rotating eccentric is arranged and from which bearing plates, on which the drum is mounted in the treatment liquid, extend downward.

This embodiment is not usable in practice, since the oscillations produced by the oscillator on the resiliently retained plate are poorly defined, and it is impossible to prevent the drum from oscillating back and forth undesirably in the container.

Known from DE OS 21 39 651 is an embodiment in which the drum is mounted with its shaft on an eccentric, and is thereby caused to oscillate in a defined fashion. The eccentric shaft is, however, mounted on a bearing arrangement outside the fronts of the container and requires a passthrough through those fronts. Extensive experience with this device has shown that effective long-term sealing of this passthrough is difficult.

OBJECTS AND SUMMARY OF THE INVENTION

An object of the invention to develop a treatment device for a continuously passing textile web such that no sealing problems occur, and that such defined oscillation of the drum is guaranteed.

In the present invention, a set of columnar supports supports a container that receives a treatment liquid. Within the container is a cylindrical rotatable drum that lies partially in the liquid. The drum is connected to vertical bearing plates, which are driven by a plurality of oscillation generators so that these bearing plates, and hence the drum, execute an oscillatory motion perpendicular to the drum axis. This is accomplished via a driven eccentric located above the intended level of treatment liquid.

In this device the eccentric mount therefore no longer engages on the shaft of the drum, but rather on the bearing plate above the liquid level. Sealing of the eccentric shaft is thus no longer necessary, since it is not located in the liquid. The torque support helps prevent uncontrolled oscillations of the drum and the bearing plates, so that the bearing plates are guided overall in desmodromic fashion.

Precise guidance of the bearing plates is important, particularly given the efforts that are presently being made to use the minimum possible bath volume for treatment devices for textile webs. The container therefore conforms as closely as possible to the drum or to the spatial region circumscribed by it in its oscillating motion.

To this end, a displacer element is provided. The displacer element also makes it possible for the interior of the drum to be kept even more liquid-free, reducing the corresponding volume.

To allow the displacer element to be made as large as possible, it is advantageous to have the support rollers engage on the outer periphery of the drum.

In a further embodiment, at least three support rollers, mounted on the bearing plates with bearing journals joined immovably thereto, are provided, thus constituting, for example, a three-point mount for the drum.

The forces occurring during oscillations of the drum perpendicular to its axis are not inconsiderable, and impose substantial stress on the support rollers if only a few, for example three, are present.

Consideration may therefore also be given to arranging the support rollers on a roller chain which rolls on an outer circular support surface. This offers the possibility of using a plurality of support rollers and distributing the forces over a plurality of transfer points.

A roller chain of this kind can have the support rollers between plate link chains on either side. In a preferred embodiment, the outer rollers provide only bracing on the support surface, and the inner rollers provide only mounting of the drum.

In principle it is sufficient if the drum is arranged so as to rotate freely, and is entrained by the web as it moves forward. In particular cases, however, it may be advantageous to drive the drum.

This can easily be carried out, when a roller chain equipped with support rollers is present, in which a drive pinion drives the roller chain, and in which the roller chain performs both the support function and the drive function.

Specifically, a drive system of this kind can be carried out with a circular support surface that is interrupted to permit passage of the chain.

Instead of support rollers, the drum can also be mounted on ring bearings provided on the bearing plates at each end. These are intended to be rolling bearings whose radial extension is small in relation to their diameter ("thin ring" bearings).

Both bearing plates are mounted on an eccentric. In order to simplify the driving of these two eccentrics, and also to ensure synchronous activity of the eccentrics without great complexity, the eccentrics of the two bearing plates are connected via a connecting shaft and driven by a drive system located on one side of the treatment device.

The torque support can be structurally implemented via a straight guide and a cooperative counterbearing, arranged so as to permit eccentric travel.

The counterbearing here constitutes a certain fixed point which prevents rotation of the bearing plate about the eccentric, but still allows the displacement of the bearing plate effected by the motion of the eccentric.

By providing that the torque support and the eccentric be located opposite one another on the bearing plate, one obtains the greatest distance between the torque support and the eccentric, and therefore the lowest forces on the torque support. In this regard the torque support engages in the lower region of the bearing plate, and the eccentric engages in the upper region of the bearing plate.

Alternatively, the torque support and eccentric can both be arranged above the drum.

The drum is intended to support the web as completely as possible, but not impede the continuous passage of the web. It can be configured to comprise axially parallel rods spaced apart and arranged in a circle on end surface rings for this purpose.

The embodiment of the periphery of the drum as a sieve may also be advisable in order to bring the support points even closer together.

BRIEF DESCRIPTION OF THE DRAWINGS

For a more complete understanding of the invention, reference is made to the embodiments illustrated in greater detail in the accompanying drawings and described below. In the drawings:

FIGS. 4 and 5 are perspective views of embodiments of roller chains suitable for supporting the drum;

DETAILED DESCRIPTION

Figure 1:
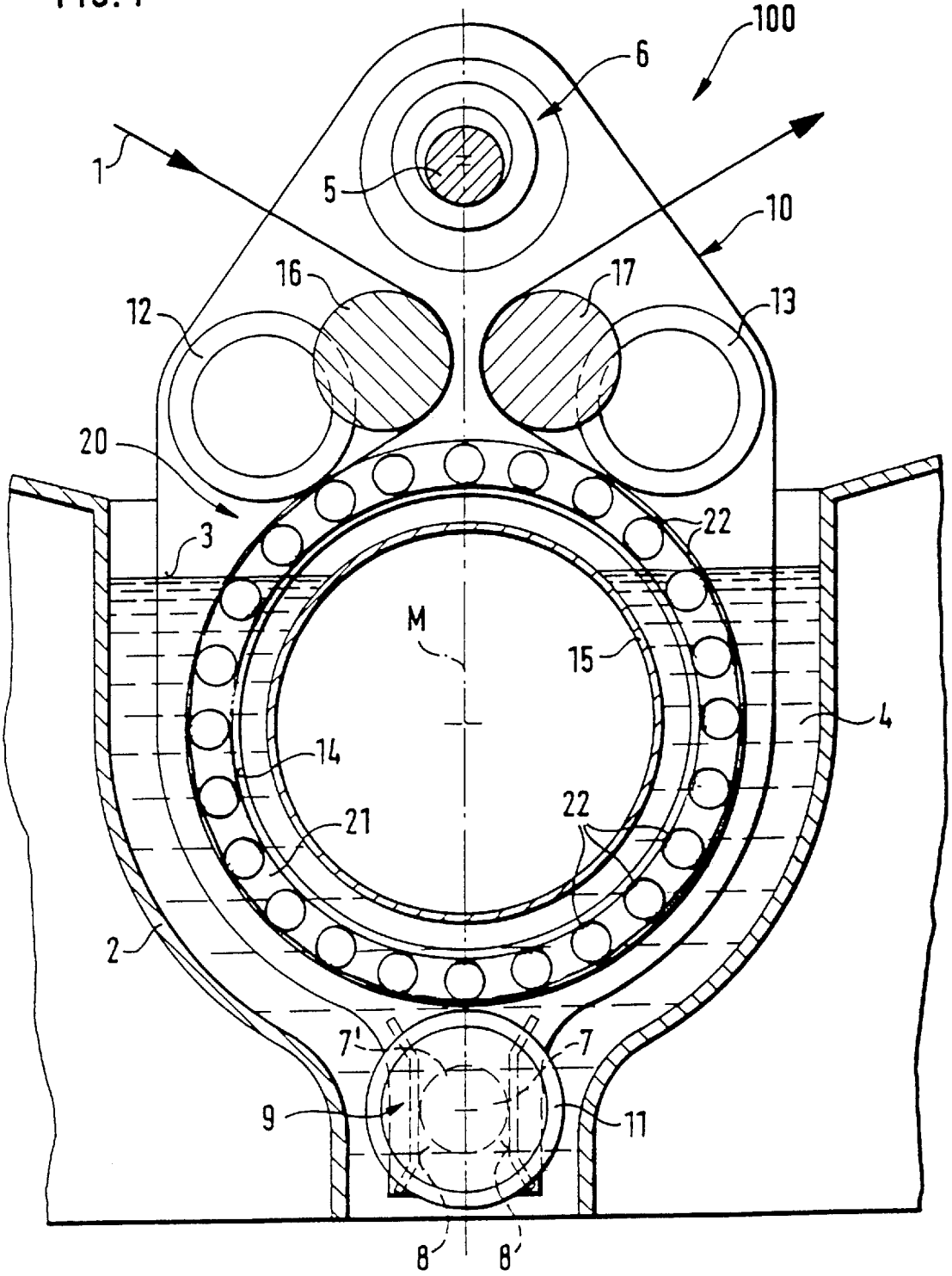
FIG. 1 schematically shows the principle of the invention in a first embodiment, as a vertical section perpendicular to the drum axis viewed toward a bearing plate.

Treatment device 100 indicated in FIG. 1 is used for wet treatment of a textile web 1 in a treatment liquid 4 located in a container 2 up to a level 3. Container 2 is retained in a machine column (not depicted) in which a rotationally driven eccentric shaft 5 is also mounted above level 3 of the treatment liquid. Arranged on eccentric shaft 5 at both ends of container 2 are eccentrics 6, on each of which is mounted a bearing plate 10 that is arranged directly inside the front, parallel to the drawing plane of FIG. 1, of container 2, i.e. in treatment liquid 4. Bearing plate 10 has the contour evident from FIG. 1, and in the exemplified embodiment of FIG. 1 is mounted in suspended fashion. As eccentric shaft 5 rotates, eccentric 6 causes a back-and-forth oscillating movement of bearing plate 10. To prevent bearing plate 10 from swinging uncontrollably, there is mounted on the end thereof, on bearing plate 10, a counterbearing 7 in the form of a roller 7' or also a corresponding slide block, which are guided between two mutually parallel guide surfaces 8 mounted in the interior of container 2 on its fronts. Counterbearing 7 and guide surfaces 8 together constitute a torque support 9, the result of which is that as eccentric 6 moves, bearing plate 10 is guided in completely positive fashion.

Two bearing plates 10 are arranged opposite one another just inside the two fronts of container 2.

Provided on the mutually facing sides of bearing plates 10 are three support rollers 11, 12, 13, rotatably mounted with the corners of an equilateral triangle on bearing plate 10, which roll on the outer periphery of a cylindrical drum labeled 20 in its entirety and guide it in rotatably defined fashion. The drum possesses at the end rings 21 against which support rollers 11, 12, 13 roll and rest from the outside, and which are interconnected by rods 22 with parallel axes, arranged close together in the circumferential direction on a portion of a circle, which constitute the drum periphery and consist of tubes. Drum 20 is thus mounted in center-free fashion on support rollers 11, 12, 13 on bearing plate 10.

Bearing plate 10 has a circular opening 14 through which passes a tubular closed displacer element 15 that is sealedly joined at its fronts to the fronts of container 2. The interior of displacer element 15 contains no treatment liquid 4. What remains for this is instead only the externally located cross section of container 2, the outer periphery of which is designed so that the wall of the container that, according to FIG. 1, is perpendicular to the drawing plane conforms as closely as possible to bearing plate 10, without bearing plate 10 striking it during its motion imparted by eccentric 6. From this standpoint, the diameter of opening 14 is also selected to be larger by a specific amount than the outside diameter of displacer element 15, which is otherwise as large as possible so that it just fits, without contact, into drum 20 which performs the eccentric movement. Mounted in stationary fashion above drum 20 on fronts 2' of container 2, close to one another and parallel to the drum axis, are reversing rollers 16, 17 over which web 1 is guided in the manner evident from FIG. 1, so that it wraps almost completely around drum 20. As eccentric 6 rotates, drum 20 performs a defined displacement perpendicular to its axis, which is communicated to web 1 wrapped around drum 20 and ensures a vigorous relative motion between web 1 and treatment liquid 4.

Reversing rollers 16, 17 do not participate in the eccentric motion of drum 20. Web 1 is therefore moved along with drum 20, and immobilized on reversing rollers 16, 17. Between them, the web runs unsupported for a short distance. This results in a positive movement of web 1 by means of treatment liquid 4 in the transition regions, and an increase in the washing effect. As experiments have shown, good to extraordinary results are obtained in shrinkage processes.

To the extent that elements functionally corresponding to the elements of FIG. 1 are present in the further Figures, identical reference symbols are used.

Figure 2:
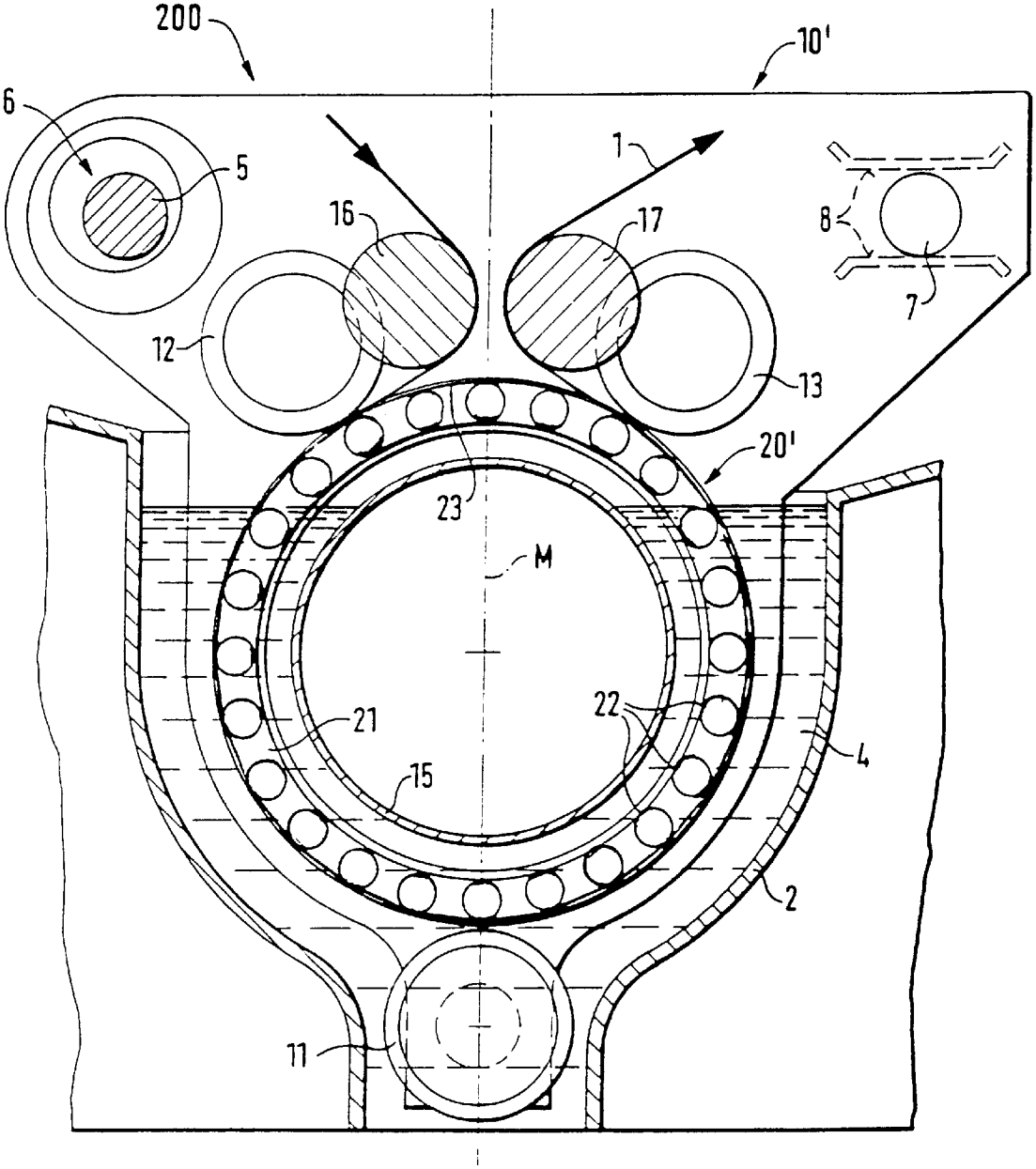
FIGS. 2 and 3 are corresponding views of second and third embodiments.

While in treatment device 100 the arrangement with respect to a vertical center line M of bearing plates 10 is arranged above drum 20, and torque support 9 is arranged vertically thereunder, in the case of treatment device 200 in FIG. 2 there is no longer a symmetrical configuration, and eccentric 6 and torque support 9 are located at approximately the same height on either side of vertical center line M, opposite one another above drum 20.

No great difference results in terms of the movement, caused by eccentric 6, of bearing plates 10' and of drum 20 mounted thereon. Drum 20' differs from drum 20 in that a cylindrical sieve fabric 23, which supports web 1 more effectively, is arranged on rods 22.

Figure 3:
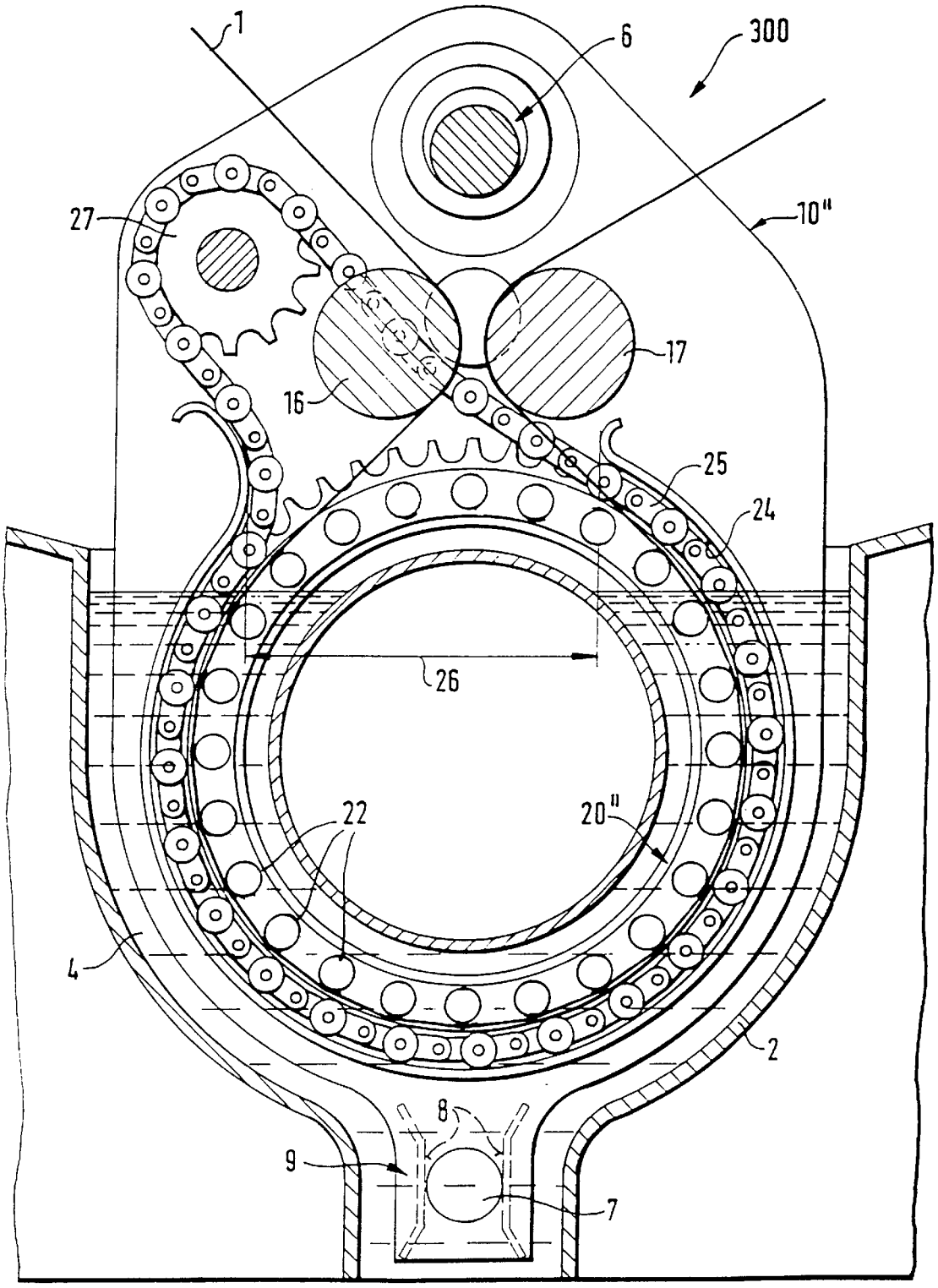

In the case of treatment device 300 of FIG. 3, the arrangement of eccentric 6, drum 20", and torque support 9 is the same as for treatment device 100 of FIG. 1. One difference, however, consists in the fact that the drum periphery is surrounded at its ends, over the majority of its periphery and with uniform radial spacing, by a circular support surface 24 constituted by a suitably shaped guide bar, which is attached to bearing plate 10" and has a cutout 26 at the top. Drum 20" is mounted on bearing plate 10" by means of a roller chain 25 which replaces the individual support rollers 11, 12, 13 of the previous embodiments, and whose rollers 30 roll on the one hand on circular support surface 24, and on the other hand on the outer periphery of drum 20".

Circular support surface 24 has, in an angular range from approximately 30 degrees to 60 degrees (in the exemplified embodiment 40 degrees), top cutout 26 through which roller chain 25 passes out of the circular guide and, outside circular guide surface 24, can wrap around a driven chain pinion 27 mounted on bearing plate 10". Drum 20" can thus be not only mounted but also driven by chain 25, while drums 20 and 20' of FIGS. 1 and 2 are freely rotatable and entrained by web 1.

FIG. 4 represents a first embodiment of a roller chain 25, which consists of an ordinary duplex plate link chain 28 that carries on both sides, on extended pins 29, rollers 30 whose diameter is greater than the height of the links of plate link chain 28 and which are generally made of plastic. The rear rollers 30 in FIG. 4 roll on circular guide surface 24, the front rollers 30 on the periphery of drum 20".

FIG. 5 depicts an alternative roller chain 25' in which once again a duplex plate link chain 28 is present, in which however rollers 30 are arranged between the two trains of plates. Here the end of drum 20" must extend, viewed axially, as far as the region of circular guide surface 24.

FIGS. 6 to 9 represent more concretely a treatment device 100 corresponding to FIG. 1. Treatment device 100 comprises a machine chassis, bolted together from sectional supports, which comprises at each end a substantially flat frame 41 with two vertical supports 42, standing next to one another with transverse spacing, which are connected at the top by a crossmember 43 and at the bottom by a crossmember 44. Frames 41 which are present at the fronts of treatment device 100 are in turn interconnected by intermediate supports 45 to form a three-dimensional structure. The drum axis extends perpendicular to the plane of frame 41.

Figure 6:
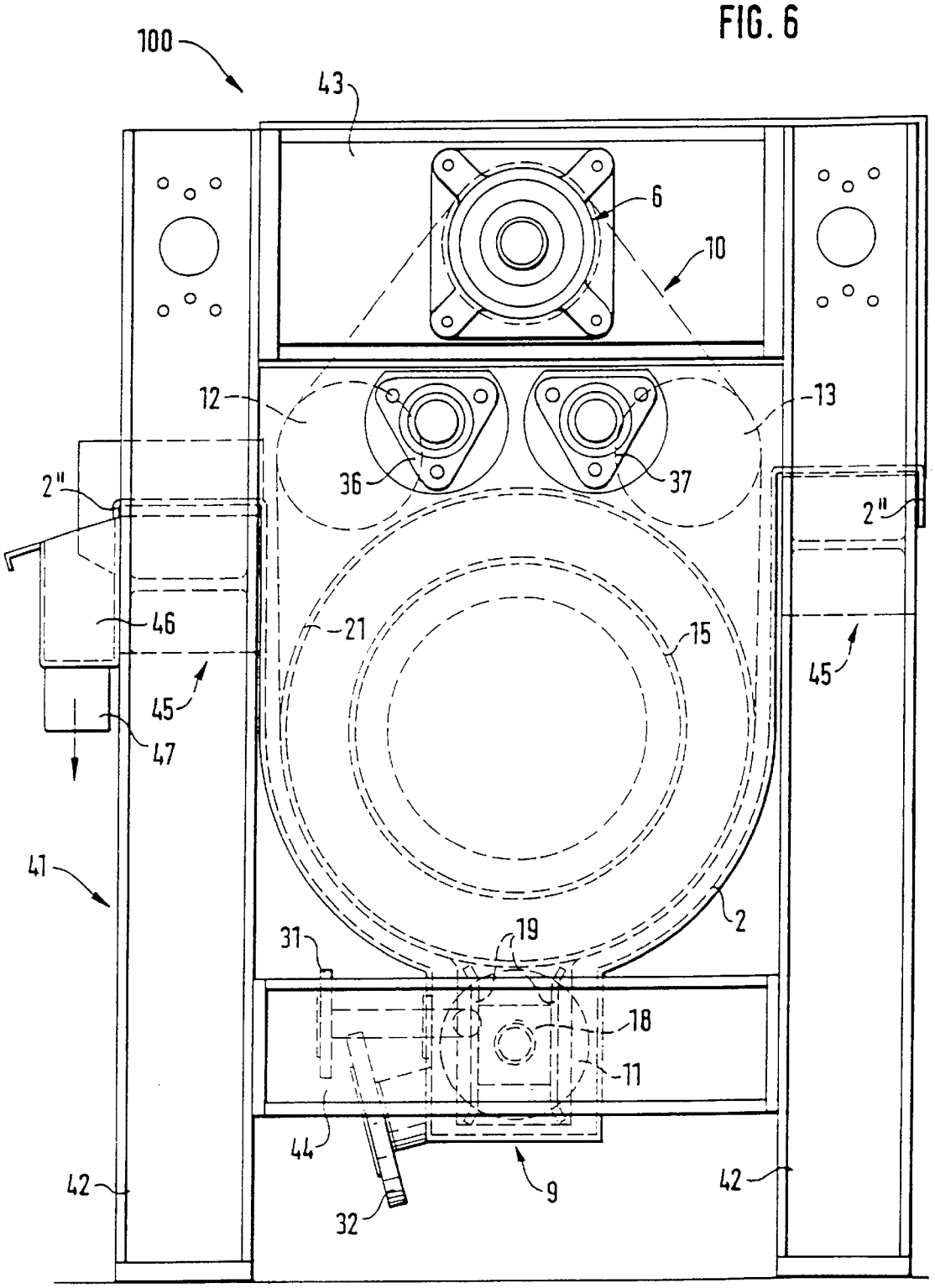
FIG. 6 shows a side view of a concrete embodiment of the treatment device.
Figure 7:
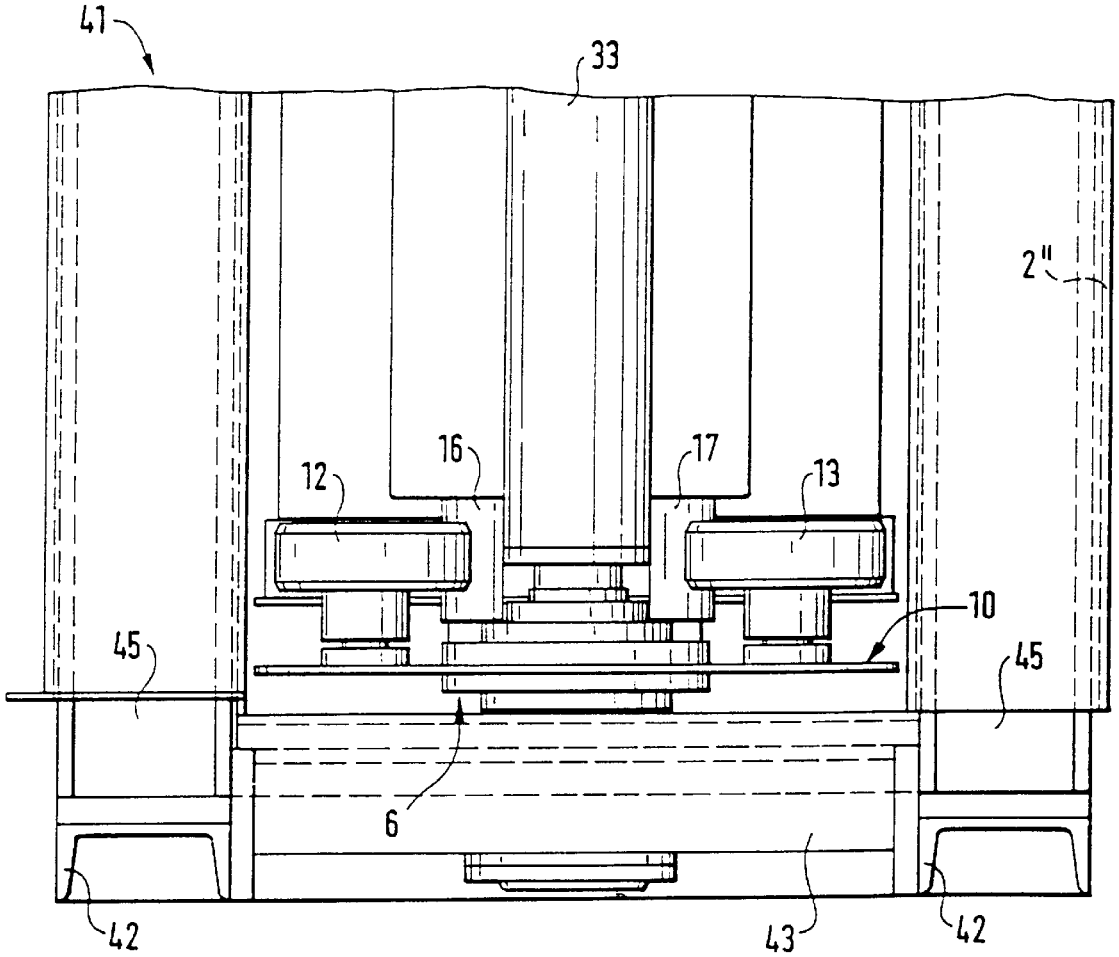
FIG. 7 shows a partial view according to FIG. 6, from above.
Figure 8:
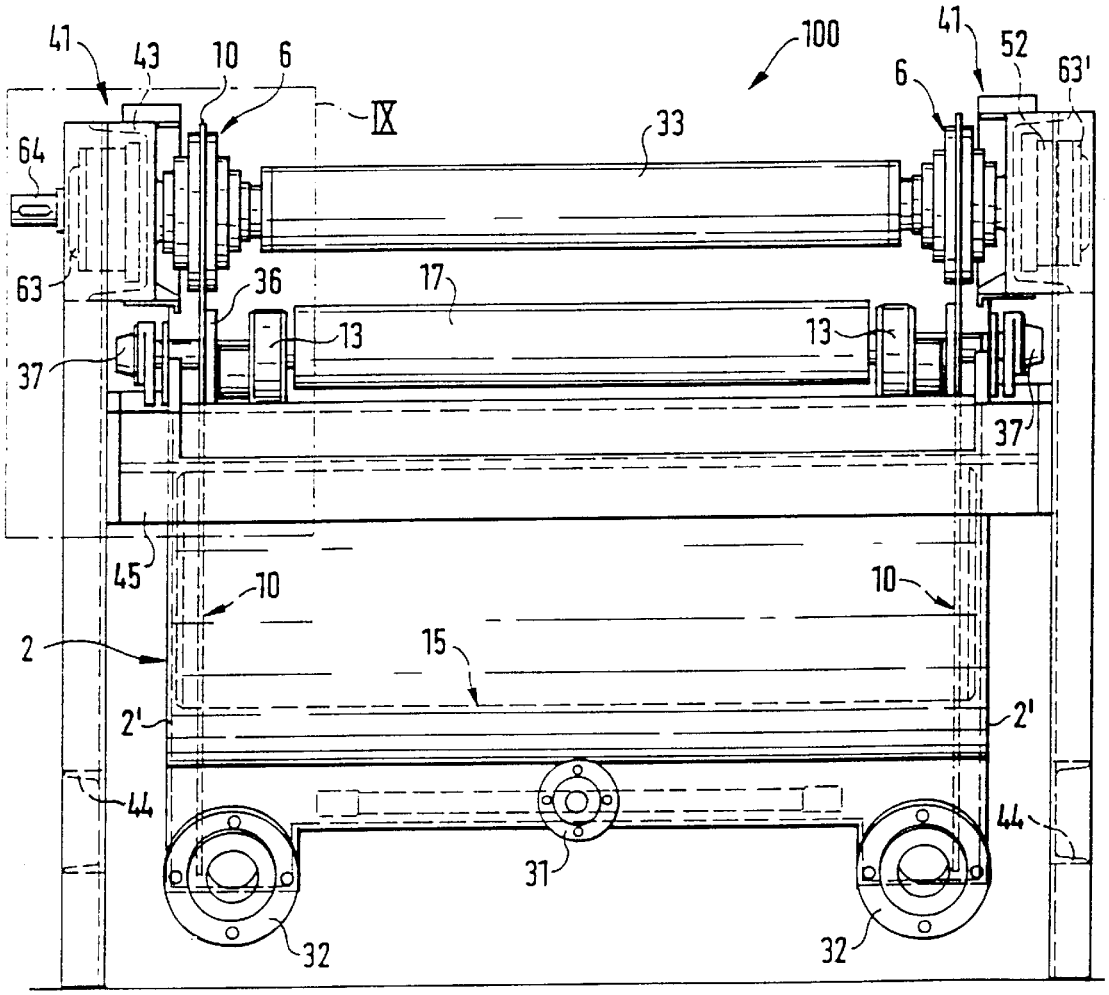
FIG. 8 shows a front view of the treatment device.

Braced on intermediate supports 45 is container 2, which has an inlet 31 for treatment liquid and two outlets 32 provided in the vicinity of the fronts, all of which open into container 2 in the lowermost region. Container 2 has the trough-shaped cross section evident from FIG. 6, and possesses at the top edges, which extend parallel to the drum axis, bends 2" which overlap intermediate supports 45. Bend 2" on the left in FIG. 6 is located somewhat lower than the right-hand one, and continues externally into an overflow slot 46 with an outlet 47, which effects automatic maintenance of level 3 of treatment liquid 4.

In the exemplified embodiment, torque support 9 is constituted by a slide block 18, rotatably mounted on bearing plate 10, that is guided between housing-mounted vertical slide rails 19. Fronts 2' of the container are substantially flat in configuration. Arranged inside the container, just in front of fronts 2', are bearing plates 10, which are mounted at their upper end on eccentric 6 which in turn is fastened in upper crossmember 43. The connecting shaft of the two eccentrics 6 is labeled 33. The bearings, attached to the bearing plate above the liquid level, for reversing rollers 16, 17 are labeled 36 and 37.

Figure 9:
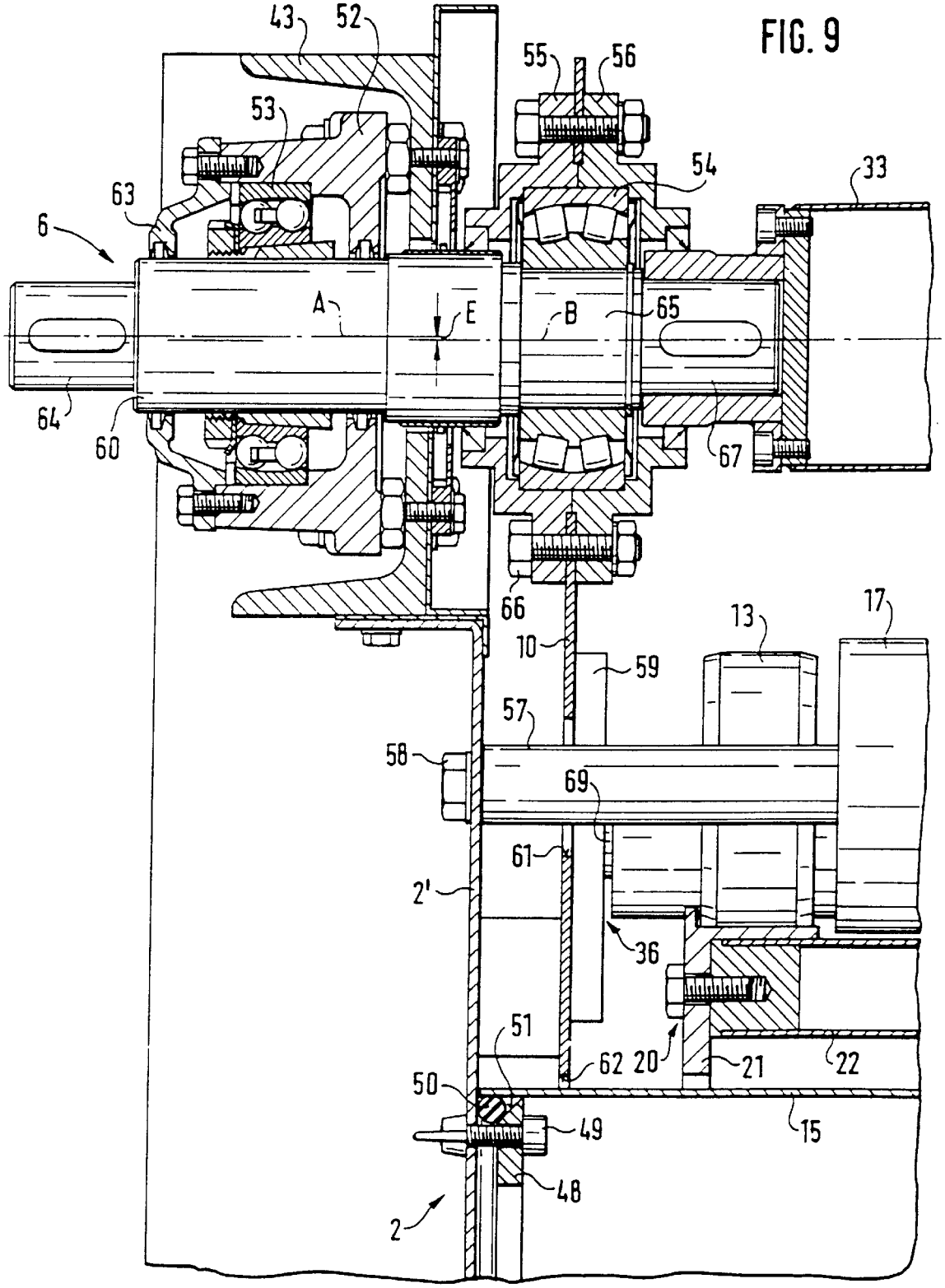
FIG. 9 shows the region labeled IX and enclosed in dot-dash lines in FIG. 8, at enlarged scale and sectioned in the vertical center plane.

The eccentric arrangement is depicted in detail in FIG. 9. The continuous eccentric shaft 5 in the schematic depiction of FIG. 1 has been replaced by mutually aligned short shaft journals. FIG. 9 shows the drive side. Shaft journal 60 rotates about axis A, and is mounted in a bearing housing 52 on upper crossmember 43 on a rolling bearing 53. On the one side it passes through cover 63 of bearing housing 52, and there has a drive journal 64 on the outside. The rotation of shaft journal 60 is transferred via connecting shaft 33 to the shaft journal mounted on the opposite side, which does not require a drive journal 64 and in which cover 63' of bearing housing 52 is accordingly closed.

On the side facing the interior of container 2, shaft journal 60 possesses an eccentric journal 65 with an axis B that is parallel to axis A, but offset laterally by the amount of eccentricity E. Arranged on eccentric journal 65 is a bearing 54 which is arranged in a housing composed of two shell-like housing halves 55, 56 placed with their open sides facing one another. Clamped between housing halves 55, 56 by means of bolts 66 is a bearing plate 10 in the form of a flat panel with a thickness of, for example, 4 mm. The contour of bearing plate 10 is evident from FIG. 6.

Provided coaxially with eccentric journal 65 and on the inside thereof is a connecting journal 67 on which connecting shaft 33 engages.

As shaft journal 60 rotates, eccentric journal 65 performs a circular motion, with a radius determined by eccentricity E, which is communicated to the upper region of bearing plate 10.

Below connecting shaft 33, reversing roller 17 is mounted in stationary fashion on a shaft journal 57 by means of a bolt 58 in front 2' of container 2. Shaft 57 passes through bearing plate 10 in an orifice 61 that leaves a spacing around the entire periphery of shaft 57 to make possible the eccentric motion of bearing plate 10.

Attached on the inside of bearing plate 10 is a bearing panel 59 with a bearing journal 69, on which support roller 13 is rotatably mounted. Support roller 13 lies behind the plane of the drawing, and rolls on the periphery of ring 21 of drum 20, which consists of parallel-axis rods 22 constituted by tubes.

Support rollers 13 and drum 20 therefore participate in the eccentric motion of bearing plate 10, while reversing roller 17 is mounted in immobilized fashion.

Ring 10 surrounds, at a distance, the closed cylindrical displacer element 15 which is designed to reduce the liquid content of container 2. Displacer element 15 consists of a sheet-metal cylinder, open at the ends, that is set flush against the inside of front 2' of container 2. Extending along the inner periphery of displacer element 15 is a sealing cord that is internally backed, axially and radially, by a ring 48 that has on its outer periphery a bevel of approximately 45 degrees against which sealing ring 50 rests. As bolts 49 are tightened, ring 48 is pulled axially against front 2' so that sealing ring 50 is pressed axially against front 2' and radially against the inner periphery of displacer element 15, and seals it on all sides.

The arrangement according to FIG. 9 is configured correspondingly on the other front of container 2.

What is claimed is:

1. An apparatus for treating a continuously moving textile web, comprising:

a plurality of columnar supports;

a container connected to the columnar supports to receive a treatment liquid;

a drum with a cylindrical outer periphery that is rotatable in the container in a treatment liquid, said drum having a drum axis;

a plurality of vertical bearing plates arranged at the ends of the drum perpendicular to the drum axis, and on which the drum is mounted rotatably about its axis and which in turn are braced on the columnar supports;

a plurality of oscillation generators, each one being operatively engaged with one of the bearing plates, by means of which the bearing plates and thus the drum can be caused to oscillate perpendicular to the drum axis;

a driven eccentric located at a position that is above the intended level of treatment liquid; and a torque support located outside of the eccentric, wherein each of the bearing plates is arranged inside the container and is mounted on the machine chassis on the driven eccentric, and is braced against oscillations about the eccentric by the torque support.

2. The treatment device as defined in claim 1, wherein:

the drum is rotatably mounted at both ends by means of support rollers braced on the bearing plates and engaging radially on the periphery of the drum;

the bearing plates have openings approximatley corresponding to the inside cross section of the drum; and a displacer element passing through the openings and sealedly connected to the fronts of the container is provided.

3. The treatment device as defined in claim 2, wherein the support rollers engage on the outer periphery of the drum.

4. The treatment device as defined in claim 3, wherein at each end of the drum, at least three support rollers, distributed over the periphery of the drum, are mounted on shafts that are immovable on the bearing plates.

5. The treatment device as defined in claim 3, wherein the support rollers are arranged on a roller chain that rolls on an outer circular support surface.

6. The treatment device as defined in claim 5, wherein the roller chain comprises rollers, arranged on both sides of a plate link chain, of which the outer ones roll on the support surface and the inner ones on the outer periphery of the drum.

7. The treatment device as defined in claim 6, further comprising a drive pinion, wherein the roller chain is drivable in its longitudinal direction by engagement with a drive pinion.

8. The treatment device as defined in claim 7, wherein the pinion and its drive system are arranged outside the treatment liquid.

9. The treatment device as defined in claim 5, further comprising a drive pinion, wherein the roller chain is drivable in its longitudinal direction by engagement with a drive pinion.

10. The treatment device as defined in claim 9, wherein the circular support surface is interrupted at a region through which the roller chain passes out of the circular track, wrapping around a pinion arranged outside the support surface.

11. The treatment device as defined in claim 9, wherein the pinion and its drive system are arranged outside the treatment liquid.

12. The treatment device as defined in claim 1, wherein the drum is mounted on the bearing plates on a ring bearing that substantially corresponds in its diameter to the drum diameter and is configured as a rolling bearing.

13. The treatment device as defined in claim 1, wherein the eccentrics of the two bearing plates are connected by a connecting shaft and driven by a drive system located on one side of the treatment device.

14. The treatment device as defined in claim 1, wherein the torque support comprises:

a straight guide; and a counterbearing coacting with the straight guide, of which one element is attached on the front of the container and the other element on the respective bearing plate, and which permit a travel, corresponding to the eccentric travel, in the direction of the straight guide and a swiveling, resulting from the eccentric travel, of the bearing plate, about the counterbearing.

15. The treatment device as defined in claim 14, wherein the torque support and the eccentric are located opposite one another on the bearing plate with respect to the drum.

16. The treatment device as defined in claim 15, wherein the torque support engages in the lower region of the bearing plate and the eccentric engages in the upper region of the bearing plate.

17. The treatment device as defined in claim 14, wherein the torque support and the eccentric are both arranged above the drum.

18. The treatment device as defined in claim 1, wherein the drum comprises axially parallel rods arranged close to one another on a circle on end-surface rings, said rods being spaced apart from one another in the peripheral direction.

19. The treatment device as defined in claim 1, wherein the drum has a sieve on the periphery.

* * * * *